US009865205B2

(12) United States Patent
Chen et al.

(10) Patent No.: US 9,865,205 B2
(45) Date of Patent: Jan. 9, 2018

(54) METHOD FOR TRANSMITTING DATA FROM TIMING CONTROLLER TO SOURCE DRIVER AND ASSOCIATED TIMING CONTROLLER AND DISPLAY SYSTEM

(71) Applicant: HIMAX TECHNOLOGIES LIMITED, Tainan (TW)

(72) Inventors: Peng-Chi Chen, Tainan (TW); Chan-Fei Lin, Tainan (TW); Yung-Chin Hsiao, Tainan (TW); Jung-Cheng Hung, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 114 days.

(21) Appl. No.: 14/599,557

(22) Filed: Jan. 19, 2015

(65) Prior Publication Data

US 2016/0210914 A1 Jul. 21, 2016

(51) Int. Cl.
*G09G 3/36* (2006.01)

(52) U.S. Cl.
CPC ..... *G09G 3/3611* (2013.01); *G09G 2330/06* (2013.01); *G09G 2370/08* (2013.01)

(58) Field of Classification Search
CPC ..... G09G 2330/06; G09G 2370/08; G09G 3/3611
USPC ..... 345/208, 204, 98–99, 211–214
See application file for complete search history.

(56) References Cited

U.S. PATENT DOCUMENTS 5,111,292 A * 5/1992 Kuriacose ..... H04N 5/4401 348/469
5,400,077 A * 3/1995 Cookson ..... H04N 7/0122 348/441
5,742,349 A * 4/1998 Choi ..... G09G 1/146 348/443
5,767,917 A * 6/1998 Gornstein ..... H04N 5/08 348/543
6,005,546 A * 12/1999 Keene ..... G06F 3/14 345/531
6,118,486 A * 9/2000 Reitmeier ..... G06T 7/2013 348/435.1
6,122,433 A * 9/2000 McLaren ..... H04N 9/8227 375/E7.211
6,222,589 B1 * 4/2001 Faroudja ..... H04N 7/0112 345/698
6,295,090 B1 * 9/2001 Voltz ..... H04N 7/0105 348/441
6,297,852 B1 * 10/2001 Laksono ..... G09G 5/12 348/500
6,340,970 B1 * 1/2002 Furuhashi ..... G09G 5/008 345/213
6,469,744 B1 * 10/2002 Pearlstein ..... G06F 3/14 348/497

(Continued)

FOREIGN PATENT DOCUMENTS

TW 201329949 A1 7/2013
TW 201405316 A 2/2014

*Primary Examiner* — Tony Davis
(74) *Attorney, Agent, or Firm* — Winston Hsu

(57) ABSTRACT

A method for transmitting data from a timing controller to a source driver includes: applying a plurality of data rates to a discrete data rate setting; and transmitting image data of a plurality of frames by using the plurality of data rates, respectively, wherein for each of the frames, its corresponding image data is transmitting by using only one of the data rates.

17 Claims, 4 Drawing Sheets

(56) References Cited

U.S. PATENT DOCUMENTS 6,867,759 B1 * 3/2005 Baek ..... G09G 3/3611 345/98
6,917,652 B2 * 7/2005 Lyu ..... H04N 19/61 348/565
7,142,245 B2 * 11/2006 Kono ..... H04N 5/74 348/441
7,242,850 B2 * 7/2007 Cok ..... H04N 5/915 348/448
7,397,283 B2 * 7/2008 Chiu ..... H04N 5/4403 326/115
7,508,449 B1 * 3/2009 Greenberg ..... H04N 7/0112 348/447
7,724,225 B2 * 5/2010 Yi ..... G09G 3/20 345/100
7,750,973 B2 * 7/2010 Nakase ..... H04N 5/772 348/231.5
7,898,535 B2 * 3/2011 Juenger ..... G09G 5/36 345/204
8,023,568 B2 * 9/2011 Rynderman ..... G11B 27/031 375/240.01
8,184,660 B2 * 5/2012 Soroushian ..... H04N 21/23614 348/390.1
8,358,373 B2 * 1/2013 Yamamoto ..... G09G 3/3648 348/441
8,368,810 B2 * 2/2013 Gong ..... H04N 7/012 348/443
8,397,272 B2 3/2013 Zhu
8,631,143 B2 * 1/2014 Simonds ..... H04N 21/21805 709/225
8,730,389 B2 * 5/2014 Kobayashi ..... G06F 3/14 348/441
8,810,689 B2 * 8/2014 Ozawa ..... H04N 5/772 348/231.3
2001/0022571 A1 * 9/2001 Nakano ..... G09G 3/3688 345/98
2005/0052572 A1 * 3/2005 Sakaniwa ..... G11B 27/022 348/441
2006/0280122 A1 * 12/2006 Honma ..... H04L 12/42 370/235
2008/0252623 A1 * 10/2008 Yi ..... G09G 5/008 345/204
2009/0109201 A1 * 4/2009 Kim ..... G09G 3/3648 345/206
2009/0284509 A1 * 11/2009 Choe ..... G09G 3/2088 345/208
2010/0007784 A1 * 1/2010 Haneda ..... G03B 7/20 348/347
2010/0141636 A1 * 6/2010 Marsanne ..... G09G 3/36 345/213
2011/0001768 A1 * 1/2011 Lin ..... G09G 3/3685 345/698
2011/0242088 A1 * 10/2011 Kim ..... G09G 3/3611 345/214
2013/0113777 A1 * 5/2013 Baek ..... G09G 3/20 345/212
2013/0219210 A1 8/2013 Kobayashi
2014/0085326 A1 * 3/2014 Jang ..... G09G 3/2096 345/600
2014/0118235 A1 * 5/2014 Hong ..... G09G 5/008 345/87
2014/0168197 A1 * 6/2014 Kobayashi ..... G09G 3/2096 345/212
2014/0176839 A1 * 6/2014 Oh ..... G09G 3/3655 349/33
2014/0184583 A1 7/2014 Wyatt
2014/0253537 A1 * 9/2014 Lee ..... G09G 5/12 345/214
2014/0347401 A1 * 11/2014 Hwang ..... G09G 3/3233 345/690
2015/0179131 A1 * 6/2015 Na ..... G09G 5/006 345/213
2015/0310824 A1 * 10/2015 Yang ..... G09G 5/006 345/213
2016/0133178 A1 * 5/2016 Oh ..... G09G 3/2092 345/208
2016/0195947 A1 * 7/2016 Morein ..... G06F 3/044 345/173
2016/0210914 A1 * 7/2016 Chen ..... G09G 3/3611
2016/0284313 A1 * 9/2016 Lin ..... G09G 5/008

* cited by examiner

METHOD FOR TRANSMITTING DATA FROM TIMING CONTROLLER TO SOURCE DRIVER AND ASSOCIATED TIMING CONTROLLER AND DISPLAY SYSTEM

BACKGROUND OF THE INVENTION

1. Field of the Invention

The present invention relates to display system, and more particularly, to a method for transmitting data from a timing controller to a source driver and associated timing controller and display system.

2. Description of the Prior Art

In a conventional point-to-point (P2P) timing controller, frame data is transmitted to a plurality of source drivers by using a single data rate. However, using a single data rate to transmit will cause a high electromagnetic interference (EMI) peak. In addition, because the P2P timing controller uses a Serializer/Deserializer (SerDes) interface to transmit the frame data, and the data rate is very high (e.g. more than 1 Gb/s), therefore, the conventional spread spectrum techniques are difficult to be applied to the P2P timing controller.

SUMMARY OF THE INVENTION

It is therefore an objective of the present invention to provide a method for transmitting data from a timing controller to a source driver and associated timing controller and display system, which uses different data rates to transmit frame data to effectively reduce the EMI peak, to solve the above-mentioned problems.

According to one embodiment of the present invention, a method for transmitting data from a timing controller to a source driver comprises: applying a plurality of data rates to a discrete data rate setting; and transmitting image data of a plurality of frames by using the plurality of data rates, respectively, wherein for each of the frames, its corresponding image data is transmitting by using only one of the data rates.

According to another embodiment of the present invention, a timing controller of a display is disclosed. The timing controller is arranged for applying a plurality of data rates to a discrete data rate setting, and transmitting image data of a plurality of frames by using the plurality of data rates, respectively, wherein for each of the frames, its corresponding image data is transmitting by using only one of the data rates.

According to another embodiment of the present invention, a display system comprises a timing controller and at least one source driver, where the timing controller is arranged for applying a plurality of data rates to a discrete data rate setting, and transmitting image data of a plurality of frames by using the plurality of data rates, respectively, to the source driver; and for each of the frames, its corresponding image data is transmitting by using only one of the data rates.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, manufacturers may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . " The terms "couple" and "couples" are intended to mean either an indirect or a direct electrical connection. Thus, if a first device couples to a second device, that connection may be through a direct electrical connection, or through an indirect electrical connection via other devices and connections.

Figure 1:
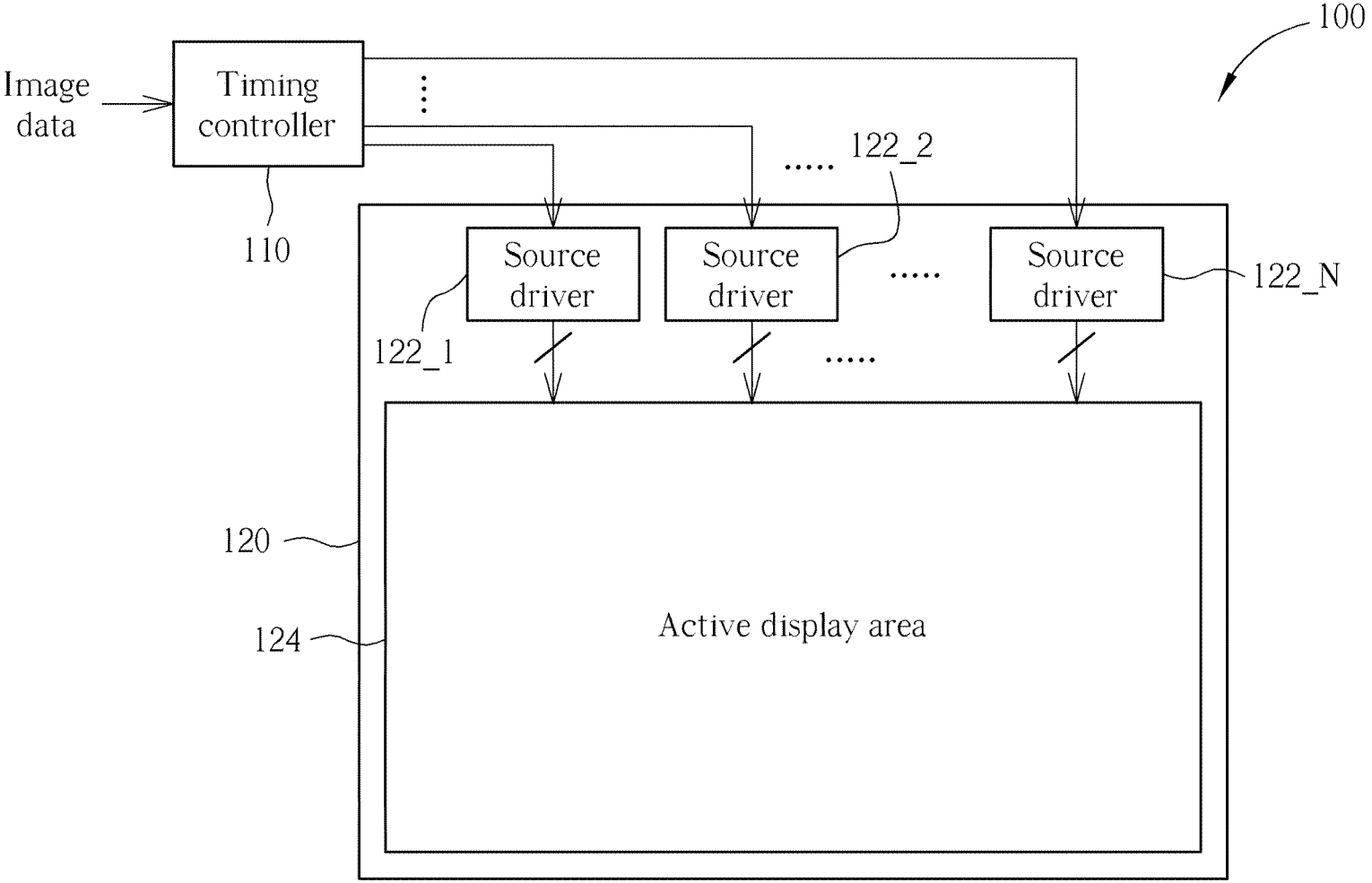
FIG. 1 is a diagram illustrating a display system according to one embodiment of the present invention.

Please refer to FIG. 1, which is a diagram illustrating a display system 100 according to one embodiment of the present invention. As shown in FIG. 1, the display system 100 comprises a timing controller 110 and a display panel 120, where the display panel 120 comprises at least one source driver (in this embodiment there are a plurality of source drivers 122_1-122_N) and an active display area 124 (the active display area 124 is also named as an active array). In this embodiment, the timing controller 110 is a P2P timing controller, and the timing controller 110 uses a Serializer/Deserializer (SerDes) interface to transmit frame data to the source drivers 122_1-122_N, respectively, and the display system 100 is a liquid crystal display (LCD).

In the operations of the display system 100, first, the timing controller 110 applies a plurality of data rates to a discrete data rate setting. Then, the timing controller 110 sequentially receives image data of a plurality of frames, and transmits the (processed) image data of the plurality of frames to each of the source drivers 122_1-122_N by using the plurality of data rates, respectively, where for each of the frames, its corresponding image data is transmitting by using only one of the data rates. Then, after receiving the image data from the timing controller 110, the source drivers 122_1-122_N transmits corresponding data to data lines of the active display area 124.

Figure 2:
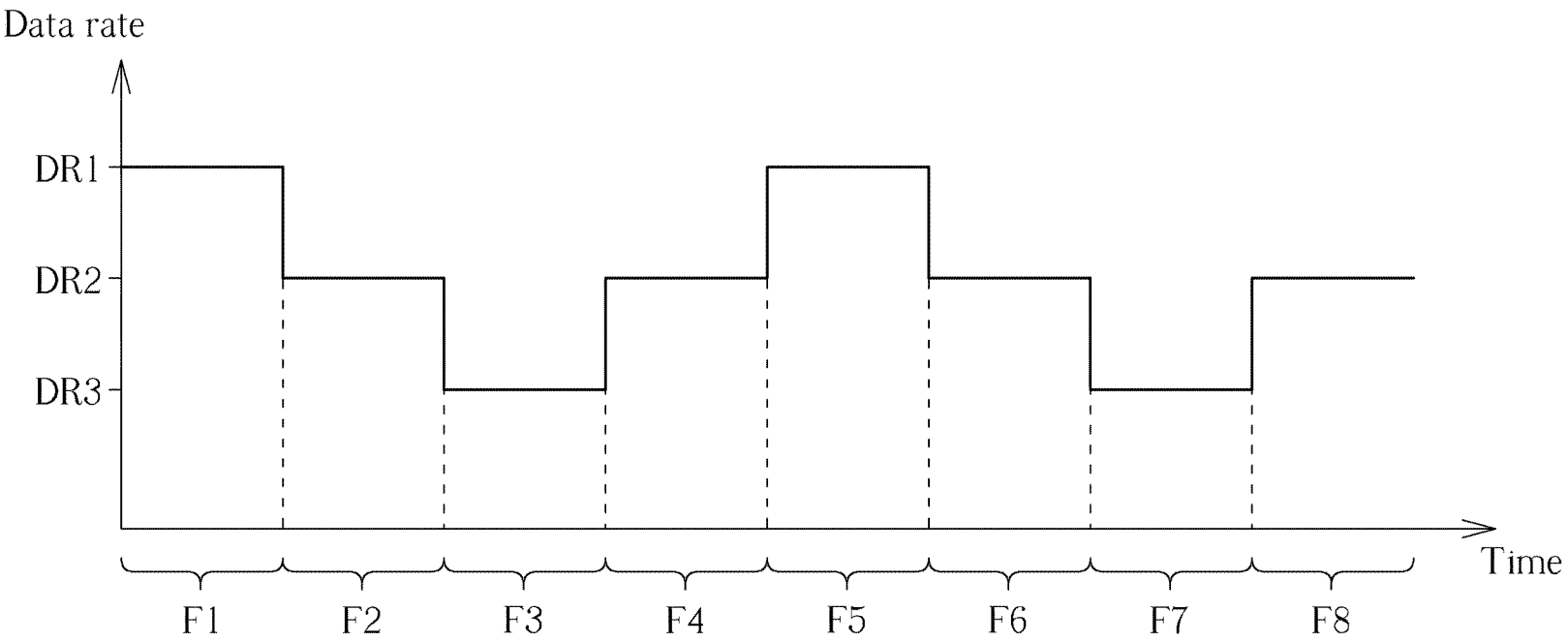
FIG. 2, which is diagram showing transmitting frames by using data rates according to one embodiment of the present invention.

In detail, referring to FIG. 2, which is diagram showing transmitting frames by using data rates DR1-DR3 according to one embodiment of the present invention. Referring to FIG. 2, the timing controller 110 uses the data rate DR1 to transmit image data of the first frame F1 to the source drivers 122_1-122_N, uses the data rate DR2 to transmit image data of the second frame F2 to the source drivers 122_1-122_N, uses the data rate DR3 to transmit image data of the third frame F3 to the source drivers 122_1-122_N, uses the data rate DR2 to transmit image data of the fourth frame F4 to the source drivers 122_1-122_N, and repeatedly uses the data rates DR1, DR2, DR3, DR2 to transmit the following frames F5, F6, F7, F8, respectively, . . . . By using different data rates to transmit the frame data, the EMI peak can be effectively reduced.

It is noted that FIG. 2 is merely for illustrative purposes only, and is not a limitation of the present invention. For example, a number of data rates can be determined according to the designer's consideration, that is the timing controller 110 may use two, four or five different data rates to transmit frame data; FIG. 2 shows that the image data of any two adjacent frames is transmitted by using different data rates, respectively, however, in other embodiments, the image data of some adjacent frames can be transmitted by using the same data rate, for example, using the data rate DR1 to transmit the frames F1-F2 and F4-F5, and using the data rate DR2 to transmit the frames F3 and F6; and in other embodiments, the data rates are not periodically used to transmit the image data of the frames. These alternative designs shall fall within the scope of the present invention.

Figure 3:
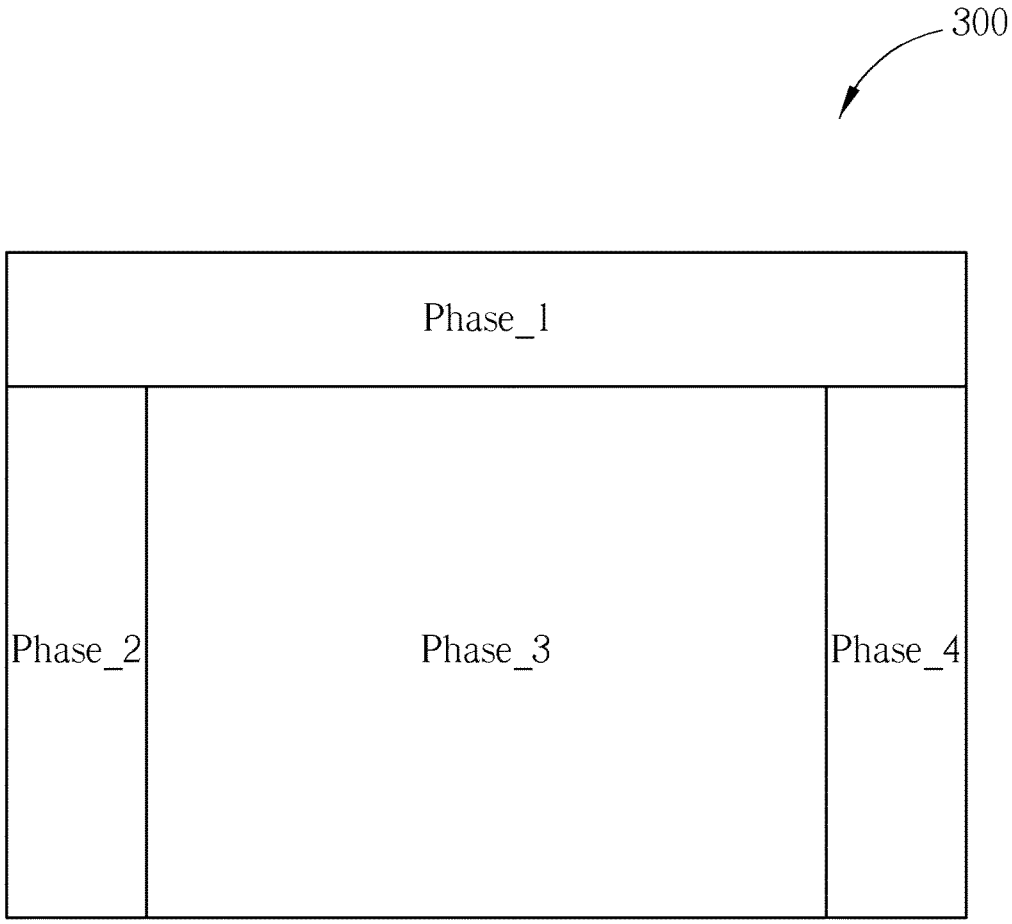
FIG. 3 is a diagram illustrating a format of a frame according to one embodiment of the present invention.

Please refer to FIG. 3, which is a diagram illustrating a format of a frame 300 according to one embodiment of the present invention. Referring to FIG. 3, the frame 300 comprises active image data and inactive data, the active image data is used to be displayed on the active display area 124, that is "Phase_3" shown in FIG. 3; and the inactive data is not displayed on the active display area 124, that is the vertical blanking interval (VBI) data, that is "Phase_1" shown in FIG. 3, and the horizontal blanking interval (HBI) data, that is "Phase_2" and "Phase_4" shown in FIG. 3. In this embodiment, the timing controller 110 switches the data rate when preparing to transmit the VBI data to the source drivers 122_1-122_N. In detail, when preparing to transmit the VBI data of the frame 300 to the source drivers, a microprocessor (MCU) built in the timing controller 110 executes a firmware code to switch an oscillator frequency offset to switch the data rate used to transmit the image data of the frame 300.

In addition, in this embodiment, for each frame to be transmitted to the source drivers 122_1-122_N, data amount of the image data of the frame is adjusted by referring to the data rate that is used to transmit the frame, especially for any two frames, the frame to be transmitted with higher data rate has greater data amount. In detail, for each frame, data amount of the inactive data, such as the VBI data and/or the HBI data, of the frame is increased or decreased by referring to the data rate that is used to transmit the image data of the frame.

Taking FIG. 2 as an example, assuming that the image data of each frame inputted into the timing controller 110 has a frame size 2040*1100, the timing controller 110 will add four lines of VBI data to the first frame F1, that is the first frame F1 has the frame size 2044*1100, and uses the data rate DR1 to transmit the first frame F1; then the timing controller 110 will add two lines of VBI data to the second frame F2, that is the second frame F2 has the frame size 2042*1100, and uses the data rate DR2 to transmit the second frame F2; then the timing controller 110 does not adjust the data amount of the third frame F3, that is the third frame F3 has the frame size 2040*1100, and uses the data rate DR3 to transmit the third frame F3 . . . and so one.

For another example, assuming that the image data of each frame inputted into the timing controller 110 has a frame size 2040*1100, the timing controller 110 may increase HBI data to make the first frame F1 have the frame size 2040*1102, and uses the data rate DR1 to transmit the first frame F1; then the timing controller 110 may not adjust the second frame F2, that is the second frame F2 has the frame size 2040*1100, and uses the data rate DR2 to transmit the second frame F2; then the timing controller 110 decrease HBI data to make the third frame F3 has the frame size 2040*1098, and uses the data rate DR3 to transmit the third frame F3 . . . and so one.

By switching the data rate of when preparing to transmit the VBI data, and adjusting data amount of the VBI data of the frame, the active display area 124 will not have flash points.

Figure 4:
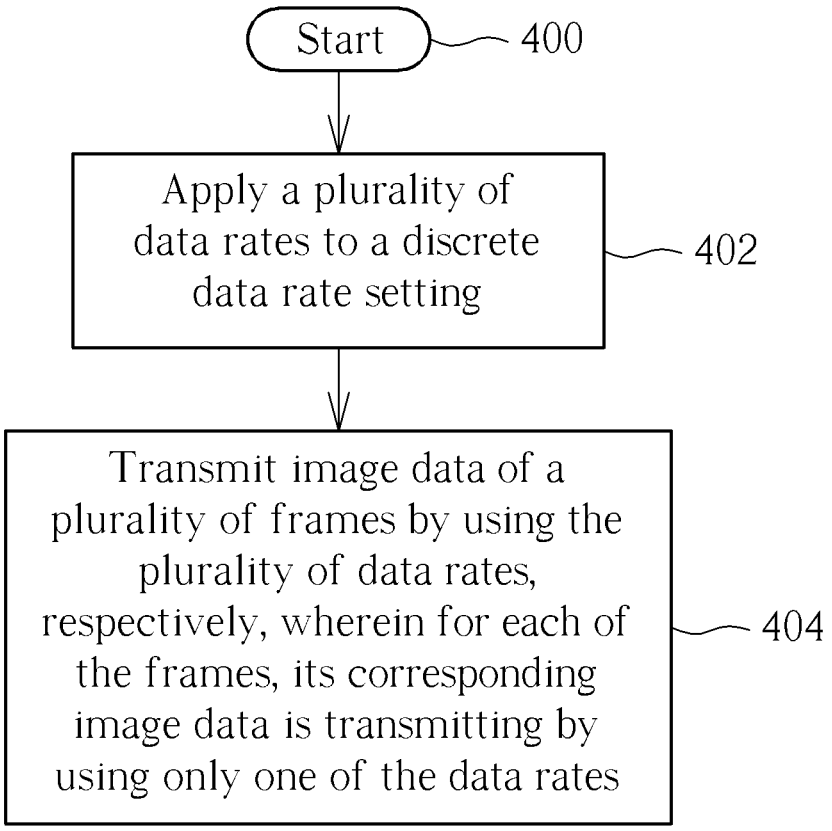
FIG. 4 is a flowchart of a method for transmitting data from a timing controller to a source driver according to one embodiment of the present invention.

Please refer FIG. 1-FIG. 4 together, FIG. 4 is a flowchart of a method for transmitting data from a timing controller to a source driver according to one embodiment of the present invention. Referring to FIG. 4, the flow is as follows:

Step 400: the flow starts.

Step 402: apply a plurality of data rates to a discrete data rate setting.

Step 404: transmit image data of a plurality of frames by using the plurality of data rates, respectively, wherein for each of the frames, its corresponding image data is transmitting by using only one of the data rates.

Briefly summarized, in the present invention, the timing controller has a discrete data rate setting, and the timing controller transmits image data of a plurality of frames by using the plurality of data rates, respectively. By using the method for transmitting data from a timing controller to a source driver and associated timing controller and display system of the present invention, the EMI peak can be reduced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for transmitting data from a timing controller to a source driver, comprising:

applying n data rates to a discrete data rate setting, where n is a positive integer greater than 1; and transmitting image data of m frames by using the n data rates, respectively, wherein m is a positive integer greater than 1;

wherein for each of the m frames, its corresponding image data is transmitted by using only one of the n data rates; and the step of transmitting the image data of the m frames by using the n data rates, respectively, comprises:

repeatedly and sequentially using the n data rates, starting from a first data rate to an $n^{th}$ data rate, to transmit the image data of the m frames, starting from a first frame to an $m^{th}$ frame.

2. The method of claim 1, wherein the image data of any two adjacent frames is transmitted by using different data rates, respectively.

3. The method of claim 1, further comprising:

for each frame to be transmitted to the source driver, adjusting data amount of the image data of the frame by referring to the data rate that is used to transmit the image data of the frame.

4. The method of claim 3, wherein each frame comprises active image data and inactive data, the active image data is used to be displayed on an active display area of a display panel, the inactive data is not displayed on the active display area of the display panel, and the step of adjusting the data amount of the image data of the frame by referring to the data rate that is used to transmit the image data of the frame comprises:

for each frame to be transmitted to the source driver, adjusting data amount of the inactive data of the frame by referring to the data rate that is used to transmit the image data of the frame.

5. The method of claim 4, wherein the step of adjusting data amount of the inactive data of the frame by referring to the data rate that is used to transmit the image data of the frame comprises:

for each frame to be transmitted to the source driver, adjusting data amount of vertical blanking interval (VBI) data and/or horizontal blanking interval (HBI) data of the frame by referring to the data rate that is used to transmit the image data of the frame.

6. The method of claim 3, wherein for any two frames, the frame to be transmitted with higher data rate has greater data amount.

7. The method of claim 1, wherein the timing controller is a point-to-point (P2P) timing controller.

8. A timing controller of a display, for applying n data rates to a discrete data rate setting; and transmitting image data of m frames by using the n data rates, respectively, to at least one source driver of the display, wherein for each of the m frames, its corresponding image data is transmitted by using only one of the n data rates, and the timing controller repeatedly and sequentially uses the n data rates, starting from a first date rate to an $n^{th}$ data rate, to transmit the image data of the m frames, starting from a first frame to an $m^{th}$ frame, where each of m and n is a positive integer greater than 1.

9. The timing controller of claim 8, wherein the image data of any two adjacent frames is transmitted by using different data rates, respectively.

10. The timing controller of claim 8, wherein for each frame to be transmitted to the source driver, the timing controller adjusts data amount of the image data of the frame by referring to the data rate that is used to transmit the image data of the frame.

11. The timing controller of claim 10, wherein each frame comprises active image data and inactive data, the active image data is used to be displayed on an active display area of a display panel, the inactive data is not displayed on the active display area of the display panel, and for each frame to be transmitted to the source driver, the timing controller adjusts data amount of the inactive data of the frame by referring to the data rate that is used to transmit the image data of the frame.

12. The timing controller of claim 11, wherein for each frame to be transmitted to the source driver, the timing controller adjusts data amount of vertical blanking interval (VBI) data and/or horizontal blanking interval (HBI) data of the frame by referring to the data rate that is used to transmit the image data of the frame.

13. The timing controller of claim 10, wherein for any two frames, the frame to be transmitted with higher data rate has greater data amount.

14. The timing controller of claim 8, wherein the timing controller is a point-to-point (P2P) timing controller.

15. A display system, comprising:

a timing controller; and at least one source driver;

wherein the timing controller is arranged for applying n data rates to a discrete data rate setting, and transmitting image data of m frames by using the n data rates, respectively, to the source driver; for each of the m frames, its corresponding image data is transmitted by using only one of the n data rates; and the timing controller repeatedly and sequentially uses the n data rates, starting from a first date rate to an $n^{th}$ data rate, to transmit the image data of the m frames, starting from a first frame to an $m^{th}$ frame, where each of m and n is a positive integer greater than 1.

16. The display system of claim 15, wherein the image data of any two adjacent frames is transmitted by using different data rates, respectively.

17. The display system of claim 15, wherein for each frame to be transmitted to the source driver, the timing controller adjusts data amount of the image data of the frame by referring to the data rate that is used to transmit the image data of the frame.

* * * * *